US006490831B1

(12) United States Patent
Candusso

(10) Patent No.: US 6,490,831 B1
(45) Date of Patent: Dec. 10, 2002

(54) MULTIPLE STRUCTURE PROFILE FOR THE PRODUCTION OF WINDOWS AND DOOR FRAMES

(75) Inventor: Bruno Candusso, Duino-Aurisina (IT)

(73) Assignee: Strato S.r.l., Monfalcone (IT)

( * ) Notice: Subject to any disclaimer, the term of this patent is extended or adjusted under 35 U.S.C. 154(b) by 0 days.

(21) Appl. No.: 09/700,878

(22) PCT Filed: May 18, 1999

(86) PCT No.: PCT/IT99/00139

§ 371 (c)(1),
(2), (4) Date: Nov. 20, 2000

(87) PCT Pub. No.: WO99/60242

PCT Pub. Date: Nov. 25, 1999

(30) Foreign Application Priority Data

May 19, 1998 (IT) ..... TS98A0006

(51) Int. Cl.[7] ..... E06B 1/04

(52) U.S. Cl. ..... 52/204.1; 52/213; 52/216; 52/309.1; 52/309.13

(58) Field of Search ..... 52/204.1, 213, 52/216, 211, 212, 309.13, 309.1, 309.16

(56) References Cited

FOREIGN PATENT DOCUMENTS

| | | | |
|---|---|---|---|
| CH | 678083 | | 7/1991 |
| EP | 0159458 | | 10/1985 |
| EP | 0421836 A1 | | 4/1991 |
| EP | 0479106 A1 | | 4/1992 |
| EP | 0695487 | | 2/1996 |
| WO | WO 91/10801 | | 7/1991 |
| WO | WO 93/06329 | * | 4/1993 |
| WO | WO 94/25716 | | 11/1994 |

* cited by examiner

*Primary Examiner*—Carl D. Friedman
*Assistant Examiner*—Jennifer I. Thissell
(74) *Attorney, Agent, or Firm*—Browdy and Neimark

(57) ABSTRACT

Profile for window and door frames which is formed by an outer metal profile (1, 2), a plastic profile (3, 4), a resin layer (5) and an inner wood fillet (6, 7). The plastic profile (3, 4) is coupled to the metal profile (1, 2) thanks to two plastic wings (8, 9) on the elastic profile engaged in grooves on the metal profile. The plastic profile (3, 4) is engaged to the wood fillet (6, 7) by the resin layer (5) which fills a channel formed by spacing the metal profile apart from the plastic profile by an arm between the two profiles.

8 Claims, 5 Drawing Sheets

MULTIPLE STRUCTURE PROFILE FOR THE PRODUCTION OF WINDOWS AND DOOR FRAMES

TECHNICAL FIELD

The invention consists of a profile formed by the union of four elements; it is validly used in the field of window and door frames.

BACKGROUND ART

The technique of connecting aluminium profiles and wood fillets aimed at forming window and door frames has been known for some time now. The metallic profile constitutes the outer part of the frame, while the wood makes its inner part. Thus, the weather resistance and waterproof properties of aluminium and the beauty and thermal insulating properties of wood are all exploited.

Metal can be coupled with wood by means of a bonding resin, which is percolated in the space present between these materials. It is for example known the European Patent filed with no. 91116315.2 and published with no. 0 479 106. In this invention, the profile is formed by metal and wood with the interposition of a bonding resin layer. The wood is divided into a plurality of laths placed tightly one close to the other adjacents held together by at least said bonding resin layer. This last one is divided by detachers. Between the bonding resin layer and the metal, also a layer of dethaching materials is applied in order to allow a longitudinal relative sliding between the bonding resin layer and the metal.

Yet, more recently, the method of coupling these materials by means of an intermediate plastic profile spread. For instance, the International Patent filed with no. PCT/EP92/02105 is well known. In this invention, the plastic profile has wings tending towards the outer part of the frame, and fit with corresponding wings created on the wall heading towards the inner part of the frame of the outer metallic profile. In detail, the fitting takes place between a rib created on the lateral internal wall of each metallic wing and a complementary groove created on the lateral outer wall of the plastic wing.

Other metallic wings can be present between the above mentioned plastic wings with the function of maintaining the latter in pretensioning during coupling. The intermediate plastic profile is equipped, on the opposite side of the one in which the above mentioned wings are positioned, with at least one rib which fits in a corresponding groove created in the wood element on the wall tending towards the external part of the frame.

The International Patent filed with no. PCT/EP94/01273 describes an interconnected profile in which, between the metal profile and the plastic profile, there is an anchorage enabling a sliding movement in a longitudinal and transversal sense between these two profiles. This anchorage is obtained by the union of the external elements of shear joint of the plastic profile and those of the metal profile and between the internal elements of joint of the two profiles constituted by two return flanges of the plastic profile and a corresponding number of flanges of the metal profile. These are equipped with a convex surface or with an angle-bent surface. The return flanges of the plastic profile, used to restore the interconnected elements after a transversal movement, are deformed during the assembling stage so that they press against the flanges of the metal profile.

Even though they do not deny the validity of the above mentioned inventions, it has to be considered the fact that the movements between the intermediate plastic profile and the wood fillet are extremely limited. Yet it is well known that, in case of a thermal shock, since the plastic material and wood have a different dilation, the frame formed in this way can undergo permanent deformations.

The ribs of the plastic profile, in both Patents, are pushed with strength in the grooves of the wood fillet. In order to ease this operation a certain tolerance between these elements is envisaged. Yet, in the minimum space that is therein created, water and air can infiltrate with the consequence of the deterioration of wood, caused by humidity, fungus, mildew etc.

Furthermore, the screws fixing the accessories of movement of each sash are fixed onto the metal profile of the sash itself, directly or after having drilled the plastic profile. The screws therefore constitute as many thermal bridges which transmit heat from the outside towards the inside of the metal profile causing condensation or even the formation of dew.

DISCLOSURE OF INVENTION

Aim of the invention is that of creating a several elements profile that, thanks to its building characteristics, does not undergo the above mentioned problems.

These as well as other aims are met by the profile for the production of window and door frames as in object, which is formed by a outer metal profile, a plastic material profile, a bonding resin layer and an inner wood fillet.

The plastic profile is equipped with two wings tending towards the outer part of the frame, which laterally embrace the metal profile and slide on it until they meet two wings made on the lateral walls of the metal profile itself. The end of each wing tending towards the outer part of the frame comprises a support pin which is shaped so it shows a rib tending towards the lateral wall of the metal profile. On each lateral wall of the latter profile, starting from the metal wing, a groove is created, having an edge at its end facing the plastic profile.

The wings of the metal profile are chamfered and thus they press the support pins, forcing their ribs to enter in the grooves of the metal profile. The shear between the tooth of each rib and the edge of the corresponding groove, even granting that the two profiles cannot detach one from the other, enables the longitudinal sliding of a profile as compared to the other.

The metal profile of each sash shows the wall facing the inner part of the frame moulded in such a way that, after the coupling of the metal profile with the plastic profile, between the two profiles a chamber is formed. Its extension is sufficient to handle the screws fixing the accessories of movement of the sash itself.

On the wall facing the wood fillet, the plastic profile furthermore comprises at least two wings tending towards the wood fillet itself. At least one of these wings or an arm extending from one of these wings is positioned on a base edge on the side of connection with the wood fillet to carry out the double function of constant fixed spacer of the wood fillet from the plastic profile and of acting as a containing part of the bonding resin percolated.

At least two wings of the wall of the plastic profile facing the wood fillet have the ends hook-bent so that between them and the named wall of the plastic profile some channels, facing each other, are formed.

In the sash, at least one of said wings of the plastic profile facing the wood fillet is extended with an arm having the function of hooking the wood fillet. In the jamb, at least one of said wings of the plastic profile facing the wood fillet is extended with an arm having the function of embracing its lateral outer wall, partially protecting it against weather. This last arm houses in an adequate groove created in the wood fillet itself.

On the wood fillet wall facing the outer part of the frame some slots are created, preferably moulded in dovetail profile.

In the dead bottom channel existing between the plastic profile, the wood fillet and the wing or arm acting as containing part the resin is injected. The resin fixes on the wood fillet. The above mentioned slots created on the wood fillet enable the resin to increase the support surface and therefore to increase the cohesion of the resin itself with wood. The resin also covers the surface of the plastic profile facing the wood fillet but it does not fix on the plastic profile. The hook-shaped wings of the plastic profile, though, act as retainers that avoid the resin to detach from the plastic profile, only enabling it to longitudinally slide with respect to it.

The so formed profile therefore enables a double longitudinal inner sliding: between the resin and the plastic profile and between the latter and the metal profile. This enables the maximum balance to thermal dilations.

The resin completely fills the slots of the wood fillet and melts with it thus strengthening the structure of the frame. The outer wall of the wood fillet is this way protected from water and air.

The screws fixing the accessories of movement of each sash are fixed to the plastic profile and are housed in the channel existing between the latter and the metal profile. Therefore the screws no longer constitute sources of conduction of the external temperature towards the inside of the metal profile.

The metal is completely isolated from the wood because between the two profiles constituted by these two materials the plastic profile and the resin are interposed. There is no contact between metal and wood.

The shear between the wings of the plastic profile and the grooves of the metal profile, thanks to the shape of the parts in contact, is extremely safe and avoid the possible detachment of the parts even though the pressure of the metal chamfered metal wings reduces (because of their flexibility) on the hooking pins.

BRIEF DESCRIPTION OF DRAWINGS

The present invention is hereinafter further clarified with reference to the enclosed sheets of drawings in which.

BEST MODE FOR CARRYING OUT THE INVENTION

Figure 1:
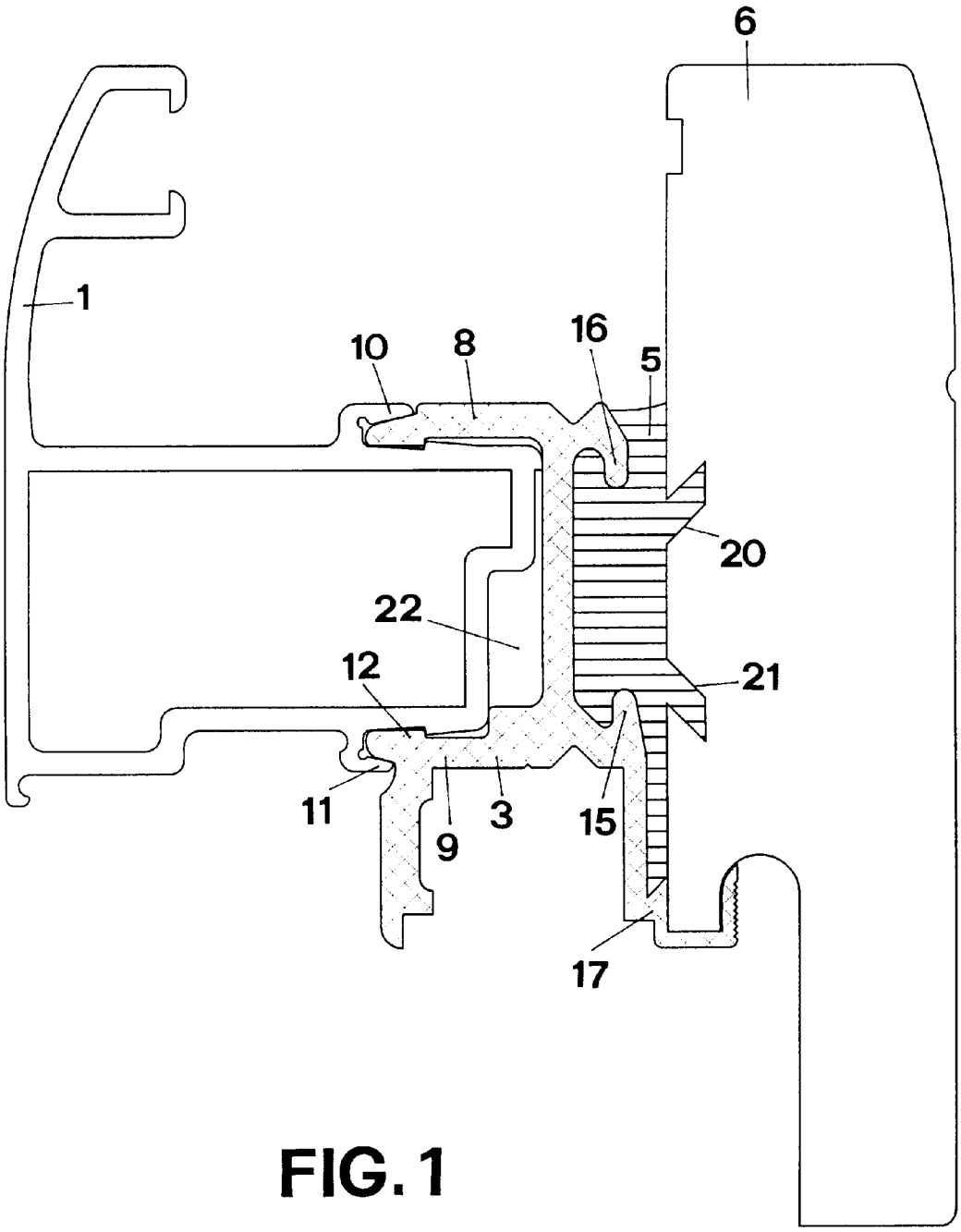
FIG. 1 shows a transversal cross section of a sash of a frame according to the invention.
Figure 2:
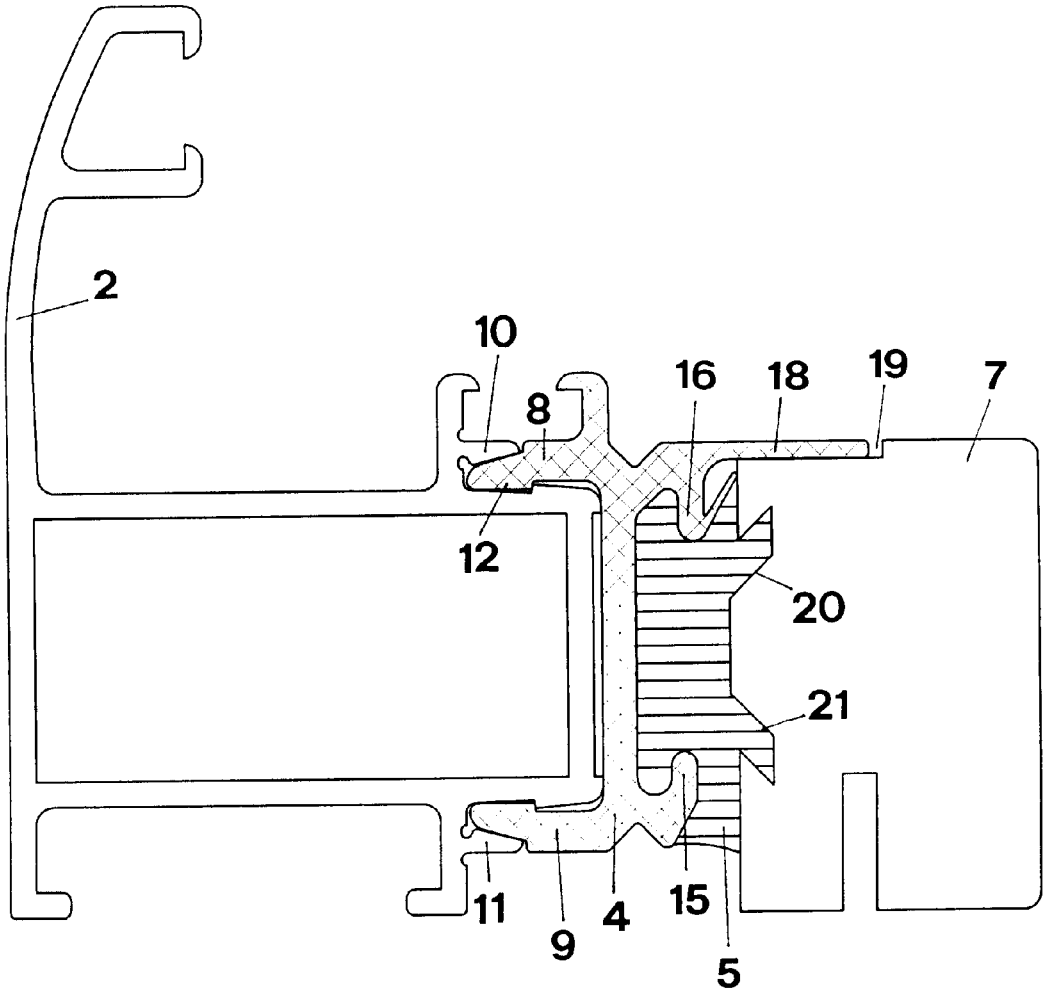
FIG. 2 shows a transversal cross section of a jamb of the same window frame.
Figure 3:
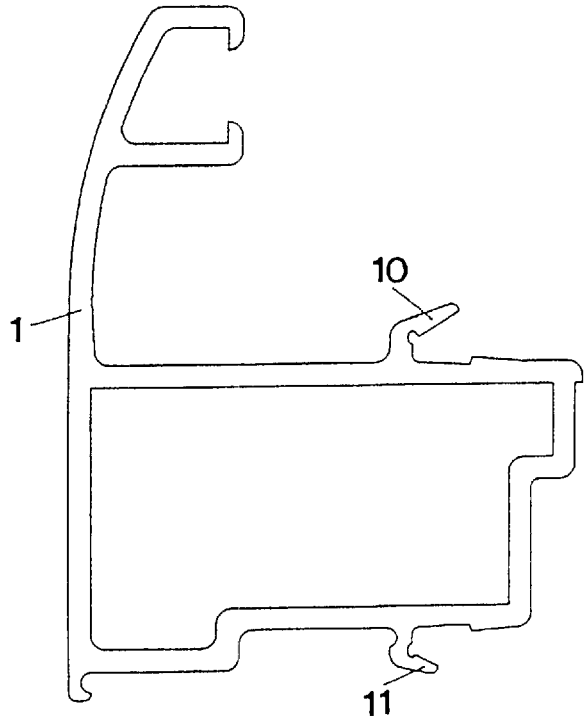
FIGS. 3 and 4 show the transversal cross section of the metal profiles used.
Figure 4:
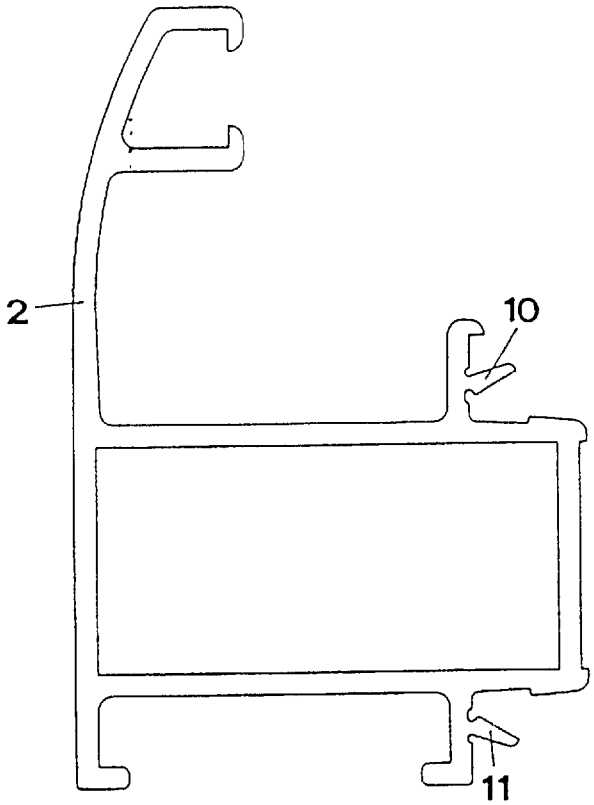
Figure 5:
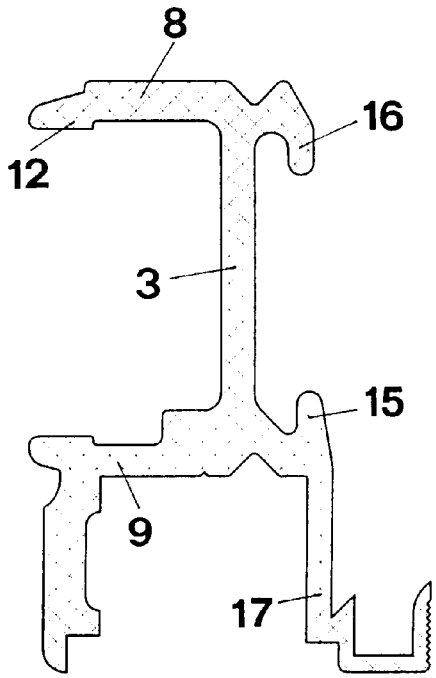
FIGS. 5 and 6 show the transversal cross section of the plastic profiles used.
Figure 6:
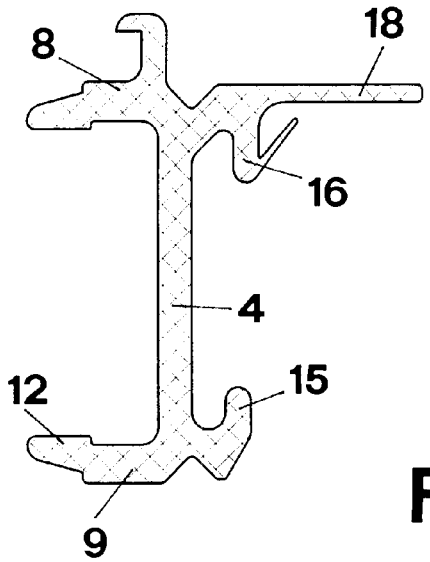
Figure 7:
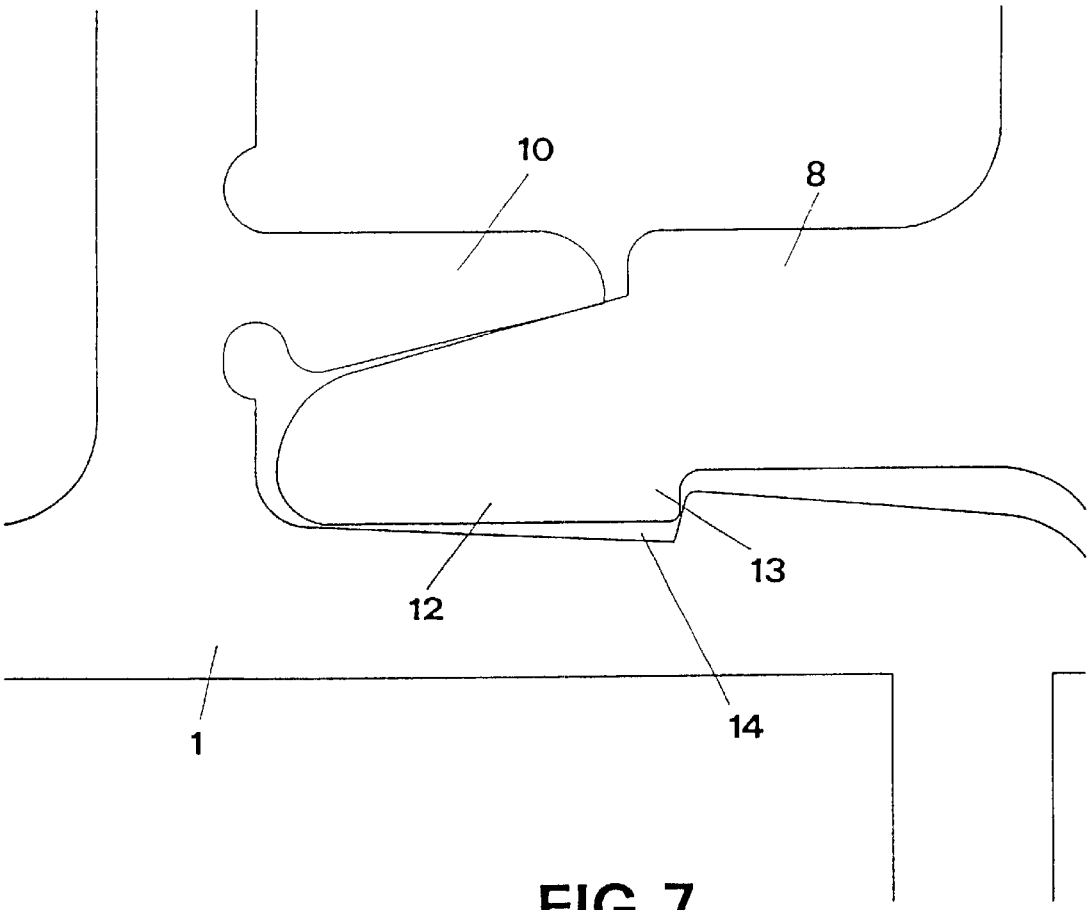
FIG. 7 shows, in more details, the transversal cross section of one of the hooking area between the metal profile and the plastic profile.

In more detail, and with reference to the enclosed drawings, the profile for the production of window and door frames as in subject has an outer metal profile 1, 2, a plastic profile 3, 4, a bonding resin layer 5 and an inner wood fillet 6, 7.

The plastic profile 3, 4 is equipped with two wings 8, 9 tending towards the outer part of the frame that embrace the metal profile 1, 2 and slide on it until they meet two wings 10, 11 created on the lateral walls of the metal profile 1, 2 itself. The distal ends of the wings 8, 9 of the plastic profile 3, 4 comprise support pins 12 which are shaped so that they show ribs 13 facing the metal profile 1, 2. In correspondence of each rib 13 on the metal profile 1, 2 a groove 14 is created, having an edge at its end facing the plastic profile 3, 4.

The wings 10, 11 of the metal profile 1, 2 are chamfered once the wings 8, 9 of the plastic profile 3, 4 are in place, which is to say when the support pins 12 face the grooves 14. The chamfered metal wings 10, 11 press the support pins 12 of the wings 8, 9 of the plastic profile 3, 4 thus forcing the ribs 13 inside the grooves 14. The tooth existing on the proximal end of each rib 13 is therefore fixed against the edge of the corresponding groove 14. Even though the flexibility of the metal wings 10, 11 tends to make them go back to their original position, the rib 13 of each support pin 12 cannot at this stage get out of the groove 14 thanks to the shear between each rib 13 and the corresponding groove 14. It prevents the profiles 1, 2, 3, 4 to detach one from the other but enables a correct sliding of the plastic profile 3, 4 with respect to the metal profile 1, 2.

The plastic profile 3, 4 shows, on the wall facing the wood fillet 6, 7, two wings 15, 16. These wings 15, 16 have the ends hook-bent so that some channels—that face each other—form between them and the wall of the plastic profile 3, 4, from which they originate.

A wing 15 of the plastic profile 3 being a part of the sash prolongs with an arm 17 whose distal end, "U" shaped, hooks to the wood fillet 6. A wing 16 of the plastic profile 4 being part of the jamb prolongs with an arm 18 which embraces the outer radial wall of the wood fillet 7 and houses in an adequate groove 19 created on the wood fillet 7.

The arm 17 of the plastic profile 3 of the sash and the wing 16 of the plastic profile 4 of the jamb are positioned on a base edge on the side of connection with the wood fillet 6, 7. They carry out the double function of fixed constant spacer of the wood fillet 6, 7 from the plastic profile 3, 4 and of being as a containing parts for the percolated bonding resin 5.

The dovetail slots 20, 21 are created on the wood fillet wall 6, 7 converging towards the outer part of the frame.

On the dead bottom channel existing between the plastic profile 3, 4, the wood fillet 6, 7 and the wing 16 or arm 17, the resin 5 is injected. The resin also fills the above mentioned slots 20, 21, created on the wood fillet 6, 7. The resin 5, once it has set, permanently fixes to the wood fillet 6, 7.

The resin 5 also covers the surface of the plastic profile 3, 4 tending towards the wood fillet 6, 7 but it does not fix to the plastic profile 3, 4 itself. The hook-shaped wings 15, 16 of the plastic profile, though, act as retainers and avoid the resin 5 to detach from the plastic profile 3, 4 only enabling it to longitudinally slide with respect to it.

The so formed four element profile therefore enables a double longitudinal inner sliding: between the resin 5 and the plastic profile 3,4 and between the latter and the metal profile 1,2.

The metal profile 1 of each sash shows the wall converging towards the inner part of the frame approximately "S"

shaped so that, after the coupling of the metal profile 1 with the plastic profile 3, between the two profiles 1, 3 a chamber 22 forms, with an extension sufficient to house the screws fixing the accessories of movement of the sash itself.

What is claimed is:

1. Multiple structure profile for the production of a window and door frame, comprising:

a metal profile (1, 2) forming an outer part of the frame, a wing (10, 11) projecting from each lateral face of the metal profile forming a groove (14) between the wing (10, 11) and the lateral face;

a plastic profile (3, 4) having two wings (8, 9) extending laterally from a first side of the plastic profile which are respectively engaged in each said groove (14), the plastic profile (3, 4) further having at least two wings (15, 16) extending from a second side of the plastic profile and having hook shaped ends forming channels facing each other, a wood fillet (6, 7) forming an inner part of the frame having dovetail profile slots (20, 21) on a side facing the second side of the plastic profile, the wood fillet (6, 7) being spaced apart from the plastic profile by an arm (17, 18) projecting from one of the two wings (15, 16) extending from the second side of the plastic profile and engaging the wood fillet (6, 7), wherein a space is formed between the plastic profile (3, 4) and the wood fillet (6, 7); and a resin layer (5) filling the space including the channels and the dovetail profile slots so as to engage the plastic profile and the wood fillet together.

2. The multiple structure profile according to claim 1, wherein the groove (14) has an edge at the lateral face and each of the two wings (8, 9) on the first side of the plastic profile has a support pin (12) with a rib (13) on a free end of the two wings (8, 9).

3. The multiple structure profile, according to claim 2, wherein the wings (10, 11) on the metal profile (1, 2) are chamfered and compress the support pins (12) on the wings (8, 9) of the plastic profile (3, 4); when the ribs (13) of the support pins (12) are pushed inside the grooves (14) of the metal profile (1, 2) to engage the metal profile (1, 2) and the plastic profile (3, 4) together.

4. The multiple structure profile, according to claim 3, wherein each rib (13) and the edge of the corresponding groove (14) are engaged to prevent the metal profile (1, 2) from detaching from the plastic profile (3, 4) but enable a longitudinal sliding of the plastic profile (3, 4) with respect to the metal profile (1, 2).

5. The multiple structure profile, according to claim 1, wherein the engagement between the plastic profile (3, 4) and the wood fillet (6, 7) is made by injecting the resin layer (5) into the space between the plastic profile (3, 4), the wood fillet (6, 7); wherein the resin (5) adheres on the wood fillet (6, 7) and covers the second side of the plastic profile (3, 4) but does not adhere to the second side, wherein the channels of the plastic profile (3, 4) act as retainers but enable the wood fillet (6, 7) to longitudinally slide with respect to the plastic profile (3, 4).

6. The multiple structure profile, according to claim 1, wherein the metal profile (1) has a wall between the lateral faces which is partially spaced apart from the first side of the plastic profile (3) to form a chamber (22) to house screws fixing accessories of a sash to the plastic profile (3).

7. The multiple structure profile, according to claim 1, wherein the arm (17) is hooked to the wood fillet (6) to enable use when manufacturing sashes.

8. The multiple structure profile, according to claim 1, wherein the arm (18) embraces a lateral outer wall of the wood fillet (7) and is housed in a groove (19) in the wood fillet (7) to enable use when manufacturing jambs.

* * * * *